US010810985B1

(12) United States Patent
Nelson, Jr.

(10) Patent No.: US 10,810,985 B1
(45) Date of Patent: Oct. 20, 2020

(54) DUAL POSITION PLACEMENT VOLUME PEDAL

(71) Applicant: Bruce E Nelson, Jr., Pensacola, FL (US)

(72) Inventor: Bruce E Nelson, Jr., Pensacola, FL (US)

( * ) Notice: Subject to any disclaimer, the term of this patent is extended or adjusted under 35 U.S.C. 154(b) by 0 days.

(21) Appl. No.: 16/666,506

(22) Filed: Oct. 29, 2019

(51) Int. Cl.
*G10H 1/34* (2006.01)
*G10H 1/46* (2006.01)
*G10H 1/00* (2006.01)

(52) U.S. Cl.
CPC ..... *G10H 1/348* (2013.01); *G10H 1/0008* (2013.01); *G10H 1/46* (2013.01)

(58) Field of Classification Search
CPC ..... G10H 1/348; G10H 1/0008; G10H 1/46
USPC ..... 84/746
See application file for complete search history.

(56) References Cited

U.S. PATENT DOCUMENTS 2,986,953 A * 6/1961 De Armond ..... G05G 1/305 74/478
3,045,522 A * 7/1962 Markowitz ..... G10H 1/0553 84/711
3,558,793 A * 1/1971 Nakada ..... G10H 1/0553 84/600
4,211,141 A * 7/1980 Jensen ..... G10H 1/057 84/711
5,136,918 A * 8/1992 Riboloff ..... G10H 3/18 84/723
5,311,806 A * 5/1994 Riboloff ..... G10H 3/182 84/728
5,834,671 A * 11/1998 Phoenix ..... G10H 1/0066 84/645
5,977,474 A * 11/1999 O'Brien ..... G10H 1/16 84/735
6,121,537 A * 9/2000 Pawar ..... G10H 3/182 84/728
6,215,055 B1 * 4/2001 Saravis ..... G10H 1/348 84/422.1
6,441,293 B1 * 8/2002 LaBarbera ..... G10H 3/146 84/290
6,800,810 B1 * 10/2004 Page ..... H01B 11/20 174/102 R
7,326,849 B2 * 2/2008 Adams ..... G10H 1/0066 84/743
7,476,799 B2 * 1/2009 Purchon ..... G10H 1/0091 84/694

(Continued)

*Primary Examiner* — David S Warren
*Assistant Examiner* — Christina M Schreiber
(74) *Attorney, Agent, or Firm* — Peter Loffler

(57) ABSTRACT

A volume pedal for a guitar is configured so that the volume pedal is at the front of an effects pedals signal chain or at the end of the signal chain depending on the desires of a user. The volume pedal attenuates the whole signal chain allowing the musician to produce swells and similar effects when at the front of the signal chain and controls overall after effects and turns down reverb and delay repeats as well as noise from overdrive/distortion pedals when at the back of the signal chain. A quad pole double throw switch controls the signal flow of the device either directing the signal to flow from guitar to potentiometer to signal chain to amplifier or from guitar to signal chain to potentiometer to amplifier depending on whether the volume pedal is at the front or the rear of the signal chain respectively.

8 Claims, 4 Drawing Sheets

(56) References Cited

U.S. PATENT DOCUMENTS 7,525,038 B2 * 4/2009 Yamada ..... G10H 1/0091 84/622
7,608,776 B2 * 10/2009 Ludwig ..... G10H 1/32 84/721
7,674,991 B2 * 3/2010 Baird ..... G10H 1/46 200/61.29
7,820,904 B1 * 10/2010 Robling ..... G10H 1/348 84/746
8,084,681 B2 * 12/2011 Schon ..... G10H 1/348 84/746
8,143,509 B1 * 3/2012 Robertson ..... G10H 3/186 84/604
8,338,689 B1 * 12/2012 Beaty ..... G10H 1/0091 84/746
8,471,136 B2 * 6/2013 Fuller ..... G10H 1/348 84/721
8,609,973 B2 * 12/2013 D'Amours ..... G10H 1/0083 84/746
8,704,075 B2 * 4/2014 Gournis ..... G10H 3/186 84/742
8,802,961 B2 * 8/2014 Juszkiewicz ..... G10H 1/34 84/746
8,957,297 B2 * 2/2015 Urry ..... G10H 1/06 84/721
9,012,748 B2 * 4/2015 Vumbaco ..... G10H 1/34 84/1
9,047,850 B1 * 6/2015 Beaty ..... G10H 1/0091
9,226,064 B2 * 12/2015 Vumbaco ..... H04R 3/00
9,478,206 B2 * 10/2016 Beaty ..... G10H 1/043
9,767,780 B1 * 9/2017 Asbury ..... G10H 1/46
9,892,719 B2 * 2/2018 Wilk ..... G10H 1/055
9,966,053 B2 * 5/2018 Mayo ..... G10H 1/0066
10,102,838 B2 * 10/2018 McHale ..... G10H 1/0008
10,170,092 B2 * 1/2019 Mayo ..... G10H 1/0008
10,395,630 B1 * 8/2019 Greenlee ..... G10H 1/0551
10,621,964 B1 * 4/2020 Boxberger ..... G10H 1/348
2005/0056142 A1 * 3/2005 Mapleston ..... G10H 1/348 84/645
2005/0252363 A1 * 11/2005 Rockett ..... G10H 1/348 84/723
2010/0269670 A1 * 10/2010 O'Connor ..... G10H 1/348 84/626
2011/0271820 A1 * 11/2011 Cockerell ..... G10H 1/348 84/746
2013/0055879 A1 * 3/2013 Clark ..... G10H 1/348 84/737
2013/0125736 A1 * 5/2013 Osborne ..... G10H 3/186 84/746
2013/0298752 A1 * 11/2013 Juszkiewicz ..... G10H 1/34 84/746
2014/0290469 A1 * 10/2014 Michaud ..... G10H 1/348 84/741
2019/0180725 A1 * 6/2019 Gause ..... G10H 5/007

* cited by examiner

DUAL POSITION PLACEMENT VOLUME PEDAL

BACKGROUND OF THE INVENTION

1. Field of the Invention

The present invention relates to a volume pedal for a musical instrument, namely a guitar, wherein the volume pedal is located at two separate placement points along the effect pedals signal chain.

2. Background of the Prior Art

Interspaced between an electric guitar and an amplifier are a series of special effects control pedals that help a guitarist shape the sound produced by the guitar. These pedals are arrayed in a chain wherein the guitar plugs into the input at the start of the chain and the output at the rear of the chain plugs into the amplifier with the signal path traveling from the guitar, through the chain wherein the signal is shaped by the use of the various pedals, before the signal finally terminates at the amplifier where the signal is converted to sound. These pedals fall into a series of broad categories, each category going into a specific position along the chain. For example, filter and gain pedals, such as overdrive/distortion, wah, and compression effects pedals, are placed at the front of the chain. Modulation pedals, such as chorus and phaser effects pedals, are placed next in the chain. Finally, time-based pedals that create ambience, such as reverb and delay pedals, are placed at the end of the chain. Of course, the above are not hard and fast rules and guitarist often experiment with various positions of their chosen pedals in order to achieve their desired sound.

One pedal that is always present in the special effects chain is the volume pedal. The volume pedal is placed at either the front of the chain or the end of the chain depending on what effect is desired from this pedal. If the volume pedal is placed at the front of the special effects pedal chain, the volume pedal attenuates the whole signal chain allowing the musician to produce swells and similar effects. This simulates the volume knob on the guitar. If the volume pedal is placed at the end of the chain, the volume pedal gives the musician overall control of after effects which turns down reverb and delay repeats as well as noise from overdrive/distortion pedals. Many musicians want both effects controlled by the volume pedal and place two volume pedals into the signal chain, one pedal at the start of the chain and the other pedal at the end of the chain and use each volume pedal to control its particular effect. While effective, this method of dual volume pedal place adds overall costs to the guitar setup, requires valuable real estate on the pedal board and increases the overall complexity of the pedal chain configuration.

What is needed is a device that allows a musician to use a single volume pedal and be able to "place" that pedal at both the start of the effects pedal signal chain so that this single volume pedal can control volume (as if the pedal is located at the start of the signal chain) and also control after effects and reverb and delay repeats (as if the pedal is at the end of the signal chain). Such a volume pedal should reduce the overall complexity of a dual volume pedal effects pedal configuration and control.

SUMMARY OF THE INVENTION

The dual position placement volume pedal of the present invention addresses the aforementioned needs in the art by providing a single volume pedal that can be simultaneously placed at the front of the effects pedal signal chain as well as at the end of the signal chain. The dual position placement volume pedal allows a single volume pedal to control volume before the effects chain as well as control after effects and reverb and delay repeats, each control procedure being independent of the other. The dual position placement volume pedal reduces the overall complexity of the effects pedal signal chain configuration and the overall use of the signal chain during instrument play. The dual position placement volume pedal is of relatively simple design and construction, being produced using standard manufacturing techniques, so that the device is relatively inexpensive to produce so as to make the invention economically attractive to potential consumers for this type of device.

The dual position placement volume pedal of the present invention is comprised of a housing that has a first input jack, a second input jack, a first output jack, and a second output jack. A pedal member is pivotally connected to the housing. The pedal member pivots between a raised position and a lowered position. A potentiometer is disposed within the housing and converts the amount of pivot of the pedal member to a first signal. A switch is switchable between a first position and a second position. When the switch is in the first position, a second signal travels from the first input jack to the potentiometer whereat the second signal is acted upon by the first signal, the second signal then travels to the first output, the second signal then travels to the second input jack, and the second signal then travels to the second output jack. When the switch is in the second position, the second signal travels from the first input jack to the first output jack, the second signal then travels to the second input jack, the second signal then travels to the potentiometer whereat the second signal is acted upon by the first signal, the second signal then travels to the second output jack. The switch is a quad pole double throw switch. A light is located on the housing such that the light is in a first state of illumination, either on or off, whenever the switch is in the first position and the light is in a second state, different relative to the first state, when the switch is in the second position. A musical instrument, such as a guitar is plugged into the first input jack and generates the second signal.

BRIEF DESCRIPTION OF THE DRAWINGS

Similar reference numerals refer to similar parts throughout the several views of the drawings.

DESCRIPTION OF THE PREFERRED EMBODIMENT

Figure 1:
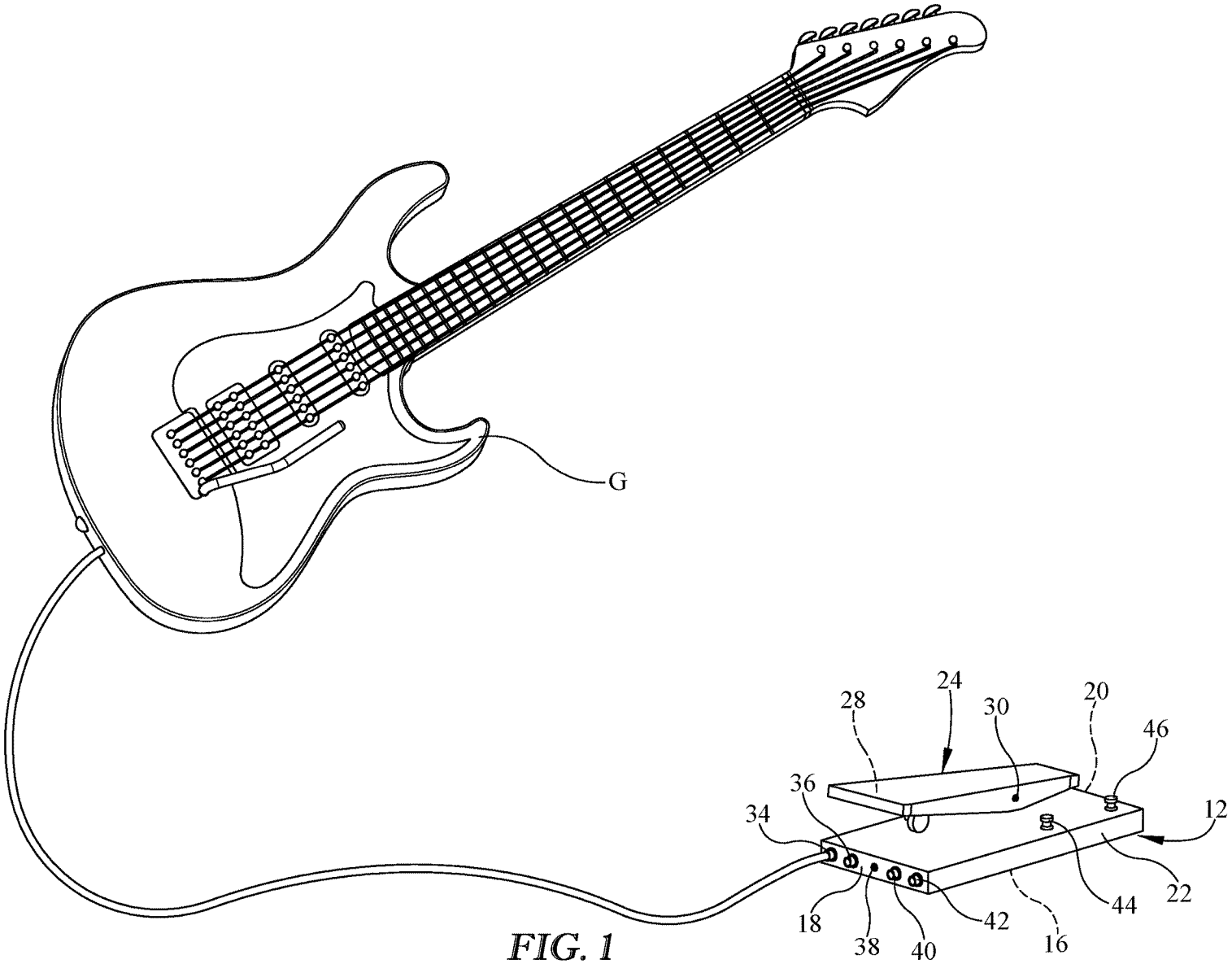
FIG. 1 is a perspective view of the dual position placement volume pedal of the present invention receiving a guitar input.
Figure 2:
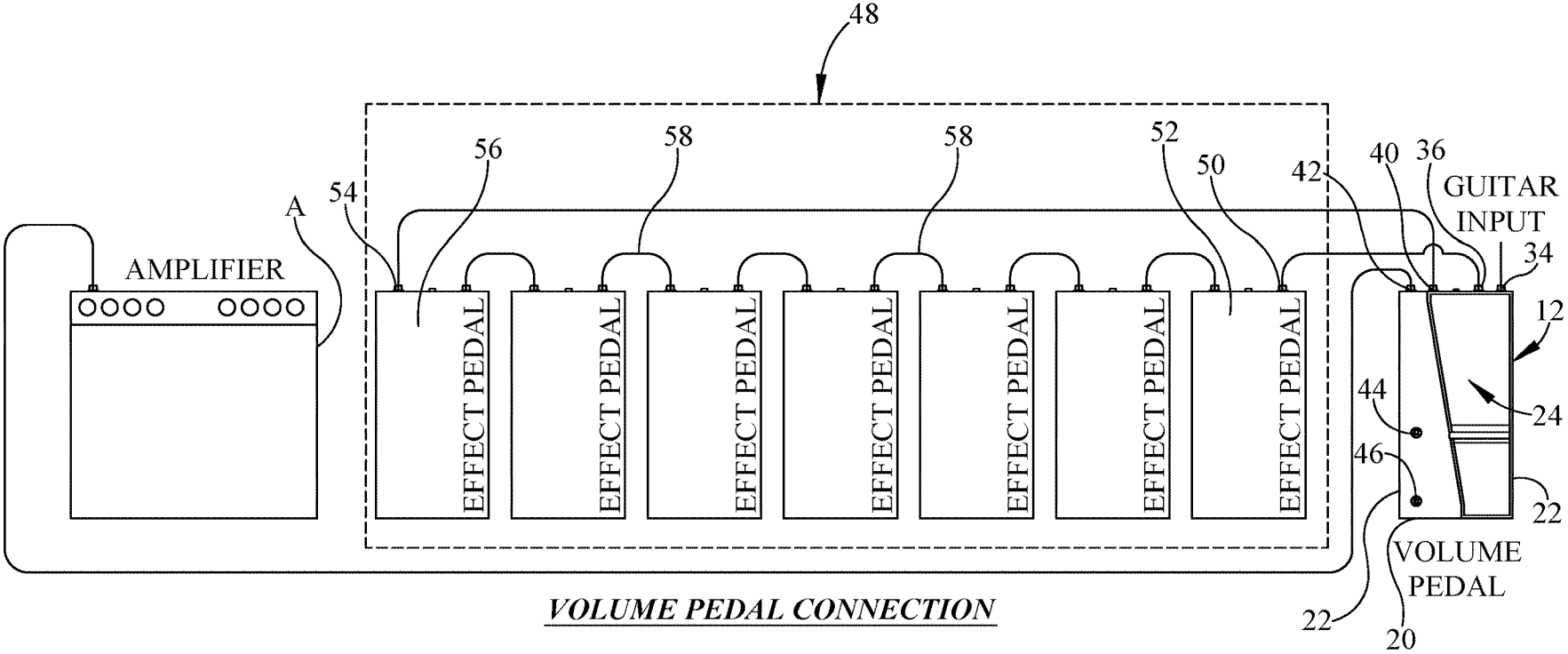
FIG. 2 is a schematic view of an effects pedal signal chain incorporating the dual position placement volume pedal.
Figure 3:
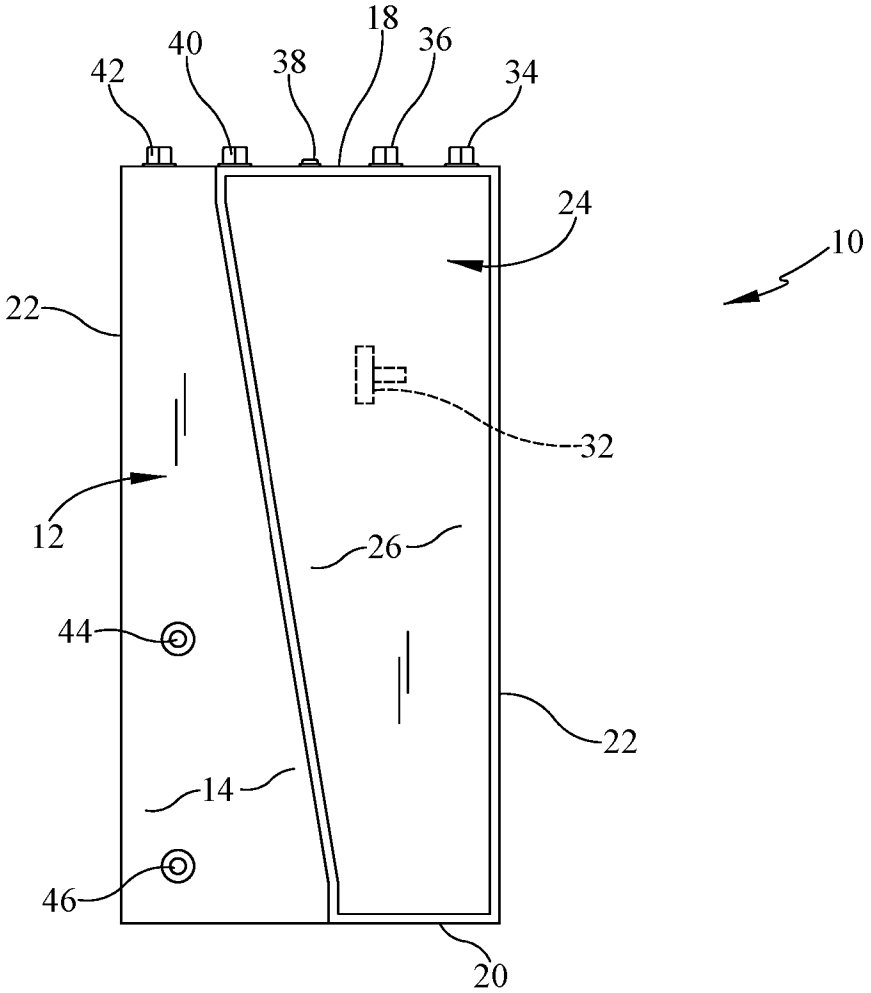
FIG. 3 is a plan view of the dual position placement volume pedal.
Figure 4:
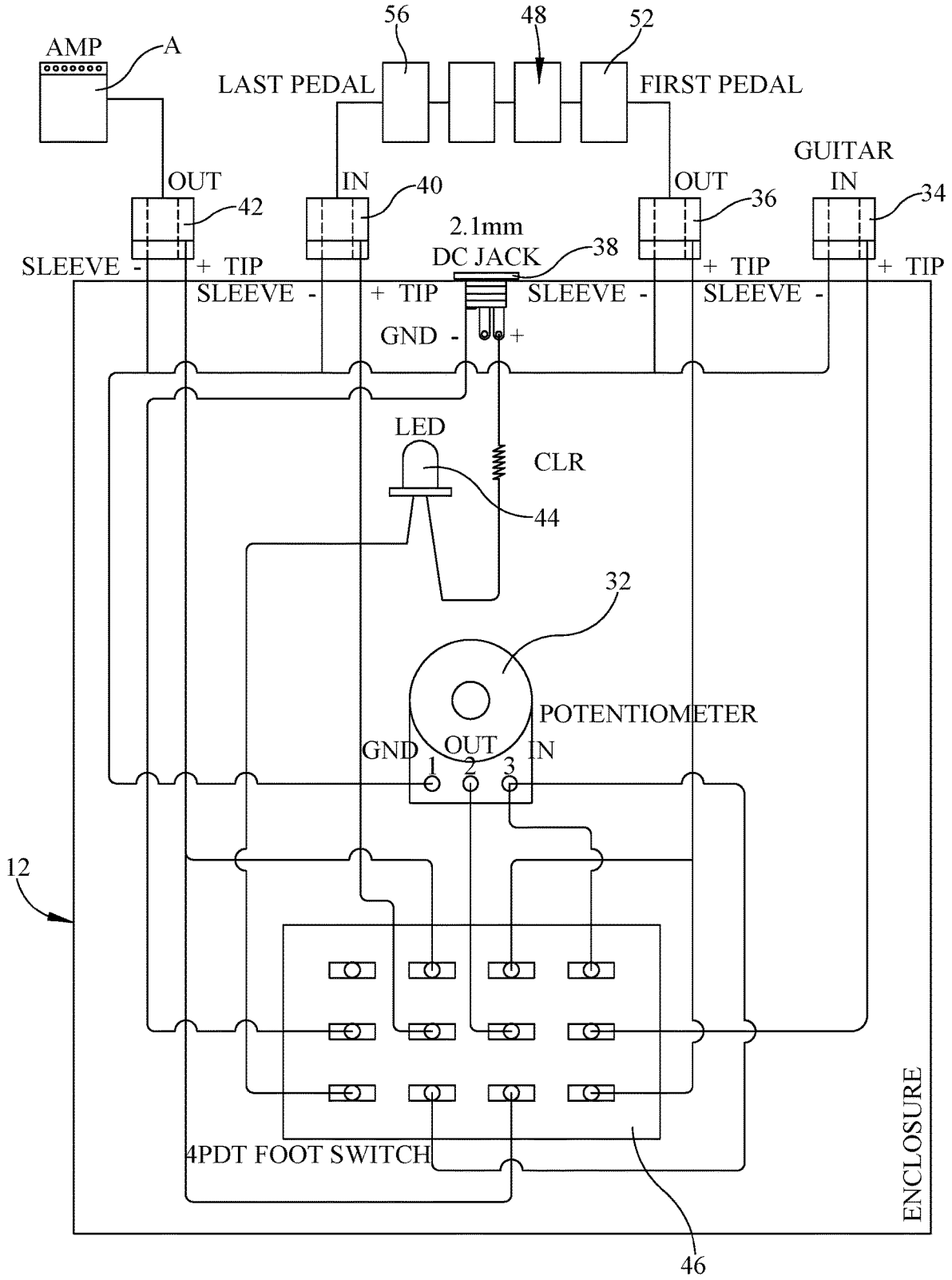
FIG. 4 is a schematic view of the major electrical components of the dual position placement volume pedal.

Referring now to the drawings, it is seen that the dual position placement volume pedal of the present invention, generally denoted by reference numeral 10, is a typical guitar foot pedal and is comprised of a pedal housing 12 that has a housing upper surface 14 and a corresponding housing lower surface 16, a front edge 18 and a corresponding back edge 20 joined by a pair of side edges 22. As seen a pedal 24 has a pedal upper surface 26 and a pedal lower surface 28 and is pivotally attached to the housing upper surface 14 of the housing 12 at a pivot point 30 in appropriate fashion. The pedal 24 extends diagonally upwardly in extending from the back edge 20 to the front edge 18 and is in a normally raised position (relatively greater angle between the housing upper surface 14 and the pedal lower surface 28). The pedal 24 can be depressed into a lowered position (relatively lesser angle between the housing upper surface 14 and the pedal lower surface 28) by putting pressure on the pedal upper surface 26 forward of the pivot point 30. The pivot point 30 has friction so that the pedal 24 can remain at any desired angle after the musician removes their foot. A potentiometer 32 is attached to the housing upper surface 14 of the pedal housing 12, forward of the pivot point 30 (between the front edge 18 and the pivot point 30), the potentiometer 32 measuring the amount of pedal 24 depression and converting this reading into an electrical signal.

As seen, located along the front edge 18 of the housing 12 is a first input jack 34 and a first output jack 36 along with a power input jack 38 and a second input jack 40 and a second output jack 42. The two input jacks 34 and 40 and the two output jacks 36 and 42 are typical mono jacks while the power input jack 38 is a typical DC input jack. Located on the first upper surface 14 of the housing 12 is an LED 44 to determine what placement the dual position placement volume pedal 10 is currently operating in, either before or after the effects chain. Also extending upwardly from the housing upper surface 14 of the housing 12 is a function switch 46 which is a quad pole double throw (4PDT) switch, the function switch 46 advantageously located proximate the back edge 20 of the housing 12 to the side of the pedal 24.

In order to configure the dual position placement volume pedal 10, an effects pedals signal chain 48 is configured in desired fashion and daisy chained in appropriate fashion. A guitar G is plugged into the first input jack 34. The first output jack 36 is connected to the input jack 50 of the lead effects pedal 52. The output jack 54 of the end effects pedal 56 of the effects pedals signal chain 48 is plugged into the second input jack 40 of the housing 12. The second output jack 42 of the housing 12 is plugged into an amplifier A. The power input jack 38 is plugged into a source of electric power in typical fashion (connection not illustrated) and permits the flow of electricity to the device. When the dual position placement volume pedal 10 is electrically energized, the LED advises the user of what virtual position the device is in so that if the LED 44 is off, the dual position placement volume pedal 10 is positioned before the effects pedals signal chain 48, and if the LED 44 is on, the dual position placement volume pedal 10 is positioned after the effects pedals signal chain 48 (or vice versa). Appropriate cables 58 are used for all connections. The function switch 46 permits the user to switch between the two positions.

As seen in the electric schematic, the function switch 46 controls the configuration between the two input jacks 34 and 40 of the housing 12, the two output jacks 36 and 42 of the housing 12, the guitar G, the effects pedals signal chain 48, and the amplifier A. Specifically, the first pole of the function switch 46 is the guitar G, with the guitar's first throw being the potentiometer 32 and the guitar's second throw being the effects pedals signal chain 48. The second pole of the function switch 46 is the potentiometer 32, with the potentiometer's first throw being the effects pedals signal chain 48 and the potentiometer's second throw being the amplifier A. The third pole of the function switch 46 is the effects pedals signal chain 48, with the effects pedals signal chain's first throw being the amplifier A and the effects pedals signal chain's second throw being the potentiometer 32. The fourth pole of the function switch 46 is the LED 44 (or other similar light) with the light's first throw being on and the light's second throw being off (or vice versa)—the fourth pole effectively acting as a single throw switch. Accordingly, when a musician has the function switch 46 set to the first throw, corresponding to the dual position placement volume pedal 10 being at the front of the effects pedals signal chain 48, the signal from the guitar G travels from the guitar G to the potentiometer 32, from the potentiometer 32 to the effects pedals signal chain 48, and from the effects pedals signal chain 48 to the amplifier A. The LED 44 is in a first state (either on or off). When the musician has the function switch 46 set to the second throw, corresponding to the dual position placement volume pedal 10 being at the end of the effects pedals signal chain 48, the signal from the guitar G travels from the guitar G to the effects pedals signal chain 48, from the effects pedals signal chain 48 to the potentiometer 32, and from the potentiometer 32 to the amplifier A. The LED 44 is in an opposing second state (either off or on). The potentiometer 32, responsive to the pedal 24 depression, controls the volume pedal in the usual way depending of which of the two positions the device is in.

While the invention has been particularly shown and described with reference to an embodiment thereof, it will be appreciated by those skilled in the art that various changes in form and detail may be made without departing from the spirit and scope of the invention.

I claim:

1. A volume pedal for a musical instrument allowing the volume pedal to be selectively placed at either input of a effect pedals signal chain or at the output of the effects pedals signal chain, the volume pedal for a musical instrument comprising:

a housing having a first input jack, a second input jack, a first output jack, and a second output jack;

a pedal member pivotally connected to the housing, the pedal member pivoting between a raised position and a lowered position;

a potentiometer disposed within the housing, responsive to the amount of pivot of the pedal member to a signal passing therethrough and varying the signal accordingly; and a double throw switch selectively positionable between a first throw position and a second throw position, the double throw switch having at a first pole to which the first input jack is connected, a second pole to which the potentiometer is connected, and a third pole to which the second input jack is connected such that when the double throw switch is in the first throw position, the signal enters into the first jack from the musical instrument, travels to and passes through the potentiometer, then travels to the first output jack and through the effects pedals signal chain, then travels to the second input jack, then finally travels to the second output jack, and when the double throw switch is in the second throw position, the signal enters into the first input jack from the musical instrument, then travels to the first output jack and through the effects pedals signal chain, then travels to the second input jack, then travels to and passes through the potentiometer, and finally travels to the second output jack.

2. The volume pedal for a musical instrument as in claim 1 further comprising a light located on the housing such that the light is in a first state of illumination, either on or off, whenever the double throw switch is in the first throw position and the light is in a second state, different relative to the first state, when the double throw switch is in the second throw position.

3. The volume pedal for a musical instrument as in claim 1 in combination with the musical instrument, the musical instrument generating the signal, the musical instrument connected to the first input jack.

4. The volume pedal for a musical instrument as in claim 3 further comprising a light located on the housing such that the light is in a first state of illumination, either on or off, whenever the double throw switch is in the first throw position and the light is in a second state, different relative to the first state, when the double throw switch is in the second throw position.

5. The volume pedal for musical instrument as in claim 3 wherein the musical instrument is a guitar.

6. The volume pedal for a musical instrument as in claim 5 further comprising a light located on the housing such that the light is in a first state of illumination, either on or off, whenever the double throw switch is in the first throw position and the light is in a second state, different relative to the first state, when the double throw switch is in the throw second position.

7. The volume pedal for a musical instrument as in claim 3 in further combination with the effects pedals signal chain.

8. The volume pedal for a musical instrument as in claim 7 further comprising a light located on the housing such that the light is in a first state of illumination, either on or off, whenever the double throw switch is in the first throw position and the light is in a second state, different relative to the first state, when the double throw switch is in the second throw position, whenever the double throw switch is in the first throw position and the light is in a second state, different relative to the first state, when the double throw switch is in the second throw position.

* * * * *